US009017020B2

(12) United States Patent
Charest

(10) Patent No.: US 9,017,020 B2
(45) Date of Patent: Apr. 28, 2015

(54) CONFIGURABLE FAN UNIT

(75) Inventor: Glenn Patrick Charest, San Jose, CA (US)

(73) Assignee: Cisco Technology, Inc., San Jose, CA (US)

( * ) Notice: Subject to any disclaimer, the term of this patent is extended or adjusted under 35 U.S.C. 154(b) by 1096 days.

(21) Appl. No.: 13/036,898

(22) Filed: Feb. 28, 2011

(65) Prior Publication Data

US 2012/0219413 A1 Aug. 30, 2012

(51) Int. Cl.

| | |
|---|---|
| ***F01D 25/28*** | (2006.01) |
| ***F04D 29/60*** | (2006.01) |
| ***F04D 25/06*** | (2006.01) |
| ***F04D 25/16*** | (2006.01) |

(52) U.S. Cl.

CPC ..... *F04D 29/601* (2013.01); *F04D 25/0613* (2013.01); *F04D 25/166* (2013.01)

(58) Field of Classification Search

CPC ..... F01D 25/28; F04D 29/60; F04D 29/601
USPC ..... 415/198.1, 199.4, 126, 213.1; 416/121, 416/127; 361/695, 713
See application file for complete search history.

(56) References Cited

U.S. PATENT DOCUMENTS

| | | | | |
|---|---|---|---|---|
| 2,554,602 | A * | 5/1951 | Sutton | 415/222 |
| 3,316,998 | A * | 5/1967 | Krug | 181/137 |
| 4,657,483 | A * | 4/1987 | Bede | 415/222 |
| 4,774,631 | A | 9/1988 | Okuyama et al. | |
| D358,639 | S * | 5/1995 | Chiu | D23/411 |
| 6,603,661 | B2 | 8/2003 | Smith et al. | 361/695 |
| 6,722,971 | B2 | 4/2004 | Gough | 454/187 |
| 7,068,505 | B2 | 6/2006 | Kosugi | 361/690 |
| 7,272,002 | B2 | 9/2007 | Drapeau | |
| 7,920,384 | B2 | 4/2011 | Westphall et al. | 361/727 |
| 7,983,039 | B1 | 7/2011 | Nguyen et al. | 361/695 |
| 8,320,120 | B1 * | 11/2012 | Chan et al. | 361/679.49 |
| 2003/0223196 | A1 | 12/2003 | Smith et al. | |
| 2005/0134140 | A1 * | 6/2005 | Fernandez-Grandizo Martinez | 310/239 |
| 2007/0019382 | A1 | 1/2007 | Gundlach | |
| 2007/0178822 | A1 | 8/2007 | Lanus et al. | |
| 2010/0328885 | A1 * | 12/2010 | Scofield et al. | 361/695 |
| 2011/0228476 | A1 * | 9/2011 | Lin | 361/695 |
| 2011/0255245 | A1 * | 10/2011 | Cheng et al. | 361/695 |
| 2011/0292602 | A1 * | 12/2011 | Narasimhan et al. | 361/692 |
| 2012/0138263 | A1 * | 6/2012 | Tang et al. | 165/80.2 |

* cited by examiner

*Primary Examiner* — Dwayne J White
*Assistant Examiner* — Su Htay

(57) ABSTRACT

In order to increase the flexibility of the positioning of a stacked computer system within a data center, a removable fan unit is positioned within the stacked computer system. The removable fan unit includes a housing and a fan housing rotatably attached to the housing. The fan housing supports a fan that is electrically connected to a connector on a side of the housing of the removable fan unit. The connector of the removable fan unit may be electrically connected to a computer system-side connector. The fan housing may be rotated into at least two different orientations relative to the housing of the removable fan unit, such that the removable fan unit moves air through the stacked computer system in at least two corresponding directions.

19 Claims, 5 Drawing Sheets

CONFIGURABLE FAN UNIT

FIELD

The present embodiments relate to a configurable fan unit.

BACKGROUND

Data centers include rows of stacked computer and/or communication systems. For cooling purposes, the computer systems draw air from the surrounding environment into the systems at one side (e.g., the front) and exhaust the air out of the systems at another side (e.g., the back). A data center may include an arrangement of hot aisles and cold aisles in order to increase the cooling efficiency of the data center. By mounting a row of the stacked computer systems in the same direction, cold air from the cold aisle will flow into the systems, and hot air will exhaust out of the systems to the hot aisle.

For the hot and cold aisle arrangement, two versions of each type of computer system (e.g., two versions of a switch), one version that provides front-to-back airflow and another version that provides back-to-front airflow, may be produced. One or more fans may be fixed in version-specific orientations in each version of the stacked computer systems to provide the respective front-to-back or back-to-front airflow. The version of the computer system (e.g., front-to-back or back-to-front) installed in a data center may depend on the location of the computer system within the data center (e.g., hot aisle or cold aisle).

DETAILED DESCRIPTION OF THE DRAWINGS

Overview

Figure 1:
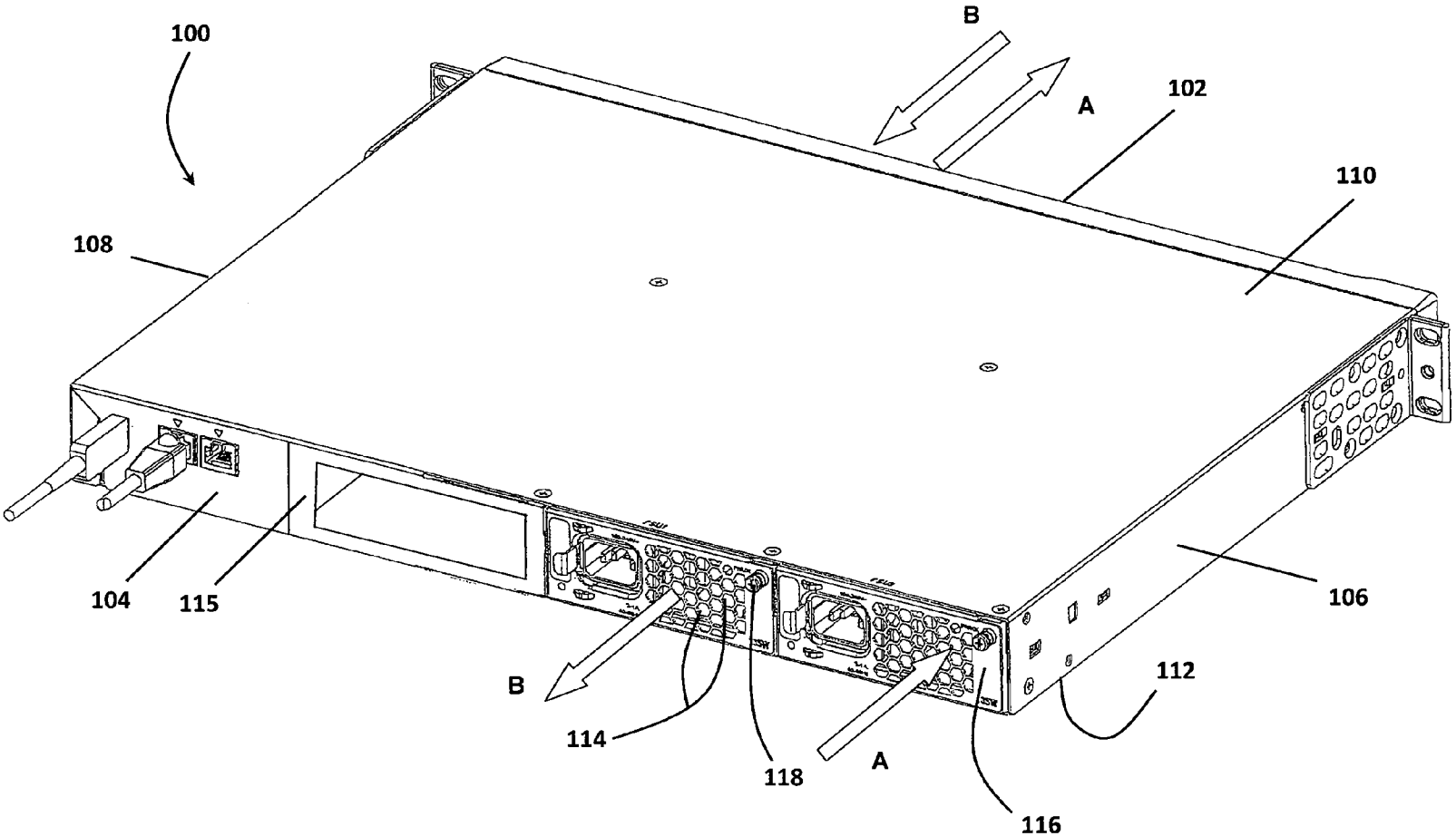
FIG. 1 illustrates a perspective view of one embodiment of a housing.

A fan tray may be installed into a stacked computer system in a single orientation, while a cooling module of the fan tray may be reoriented by a customer or service personnel to change the airflow direction through the stacked computer system.

In order to increase the flexibility of the positioning of a stacked computer system within a data center, a removable fan unit is positioned within the stacked computer system. The removable fan unit includes a housing and a fan housing rotatably attached to the housing. The fan housing supports a fan that is electrically connected to a connector on a side of the housing of the removable fan unit. The connector of the removable fan unit may be electrically connected to a stacked computer system-side connector. The fan housing may be rotated into at least two different orientations relative to the housing of the removable fan unit such that the removable fan unit moves air through the stacked computer system in at least two corresponding directions.

In one embodiment, an apparatus includes a housing including a side, a fan unit housing rotatably attached to the housing, a fan supported by the fan unit housing, and an electrical connector on the side of the housing. The electrical connector is electrically connected to the fan. The fan unit housing is operable to be rotated into two different positions relative to the housing such that the fan moves air through the housing in two corresponding directions relative to the housing.

In another embodiment, an apparatus includes a rack-mounted electrical hardware component including a heat generating component, and a fan unit removably insertable into the rack-mounted electrical hardware component. The fan unit includes a housing including a side, a fan housing rotatably attached to the housing, and a plurality of fans supported by the fan housing. The fan unit also includes an electrical connector on the side of the housing. The electrical connector is electrically connected to the plurality of fans with a wire. The fan unit includes a wire support that is configured to guide the wire when the fan housing is rotated relative to the housing. The electrical connector on the housing is operable to be physically mated with and electrically connected to a corresponding rack-mounted electrical hardware component-side connector. The fan housing is operable to be rotated into two different positions relative to the housing such that the plurality of fans move air through the rack-mounted electrical hardware component in two corresponding directions to cool the heat generating component.

In yet another embodiment, a method includes rotating a fan unit of a removable fan tray into a first orientation relative to a housing of the removable fan tray. The fan unit is rotatably attached to the housing of the removable fan tray such that the fan unit is rotatable to the first orientation and a second orientation different than the first orientation. The first orientation is configured to move air in a first direction, and the second orientation is configured to move air in a second direction. The method also includes electrically connecting the fan unit of the removable fan tray to an electrical hardware system, the connection configured to power the fan unit. Electrically connecting the fan unit includes physically mating an electrical connector on the removable fan tray with an electrical hardware system-side connector.

Example Embodiments

FIG. 1 illustrates a perspective view of one embodiment of a box-type housing 100 for stacking. The housing 100 includes a front 102, a back 104, a first side 106 and a second side 108. The housing 100 also includes a top 110 and a bottom 112. The box-type housing 100 may be any number of shapes including, for example, a rectangular box. Other non-box housings may be used.

The back 104 of the housing 100 includes a plurality of holes 114 (e.g., air intakes/outtakes). The plurality of holes 114 may be equally-sized and equally-spaced. Other patterns of holes or a single hole may be used. In one embodiment, the back 104 and the top 110 of the housing 100 form a slot that extends along at least a portion of the length of the back 104 of the housing 100. In another embodiment, the back 104 and the top 110 of the housing 100 form a plurality of slots spaced along at least a portion of the length of the back 104 of the housing 100.

The front 102 of the housing 100 and/or the top 110 of the housing 100 form a plurality of slots, holes, or both (e.g., air outtakes/intakes). The plurality of slots may be spaced along the length or a portion of the length of the front 102 of the housing 100. In one embodiment, a single slot runs the length of the front 102 of the housing 100. In another embodiment, the front 102 of the housing 100 includes a plurality of equally-sized holes. Additional openings (e.g., holes and/or slots) may be included in the front 102, the back 104, the first side 106, the second side 108, the top 110 and/or the bottom 112 of the housing 100. The openings may be near but not on the back and/or front.

A configurable fan unit 115 may be supported by the bottom 112 of the housing 100. The configurable fan unit 115 may be used to move air through the housing 100. The configurable fan unit 115 may be attached to the back 104 and/or another surface of the housing 100 using, for example, screws and corresponding holes (e.g., tapped holes) in the back 104 and/or the other surface of the housing 100. In other embodiments, the configurable fan unit 115 may be attached to the housing 100 using, for example, nut/bolt combinations, flanges, tabs, other devices, or a combination thereof.

In one embodiment, air is pulled into the housing 100 at the plurality of holes 114 and the configurable fan unit 115 in the back 104 of the housing 100 and pushed out of the housing 100 at the plurality of slots in the front 102 of the housing 100, as shown by arrow A. In another embodiment, air is pulled into the housing 100 at the plurality of slots in the front 102 of the housing and pushed out of the housing 100 at the plurality of holes 114 and the configurable fan unit 115 in the back 104 of the housing 100, as shown by arrow B.

The housing 100 may be a housing of a switch, for example. The switch may include a plurality of components such as, for example, a plurality of input/output (I/O) connectors (e.g., RJ45 connectors or SFP connectors) at the front 102 of the housing 100. I/O is used for only input, only output, or both input and output.

The bottom 112 of the housing 100 may support a printed circuit board (PCB; shown in FIG. 2) or a substrate, and a plurality of heat generating electrical hardware components may be supported by and electrically connected (e.g., soldered) to the PCB. The plurality of heat generating electrical hardware components may include, for example, processors, circuits, transistors, memory devices, power supplies, or other electronics.

Heat sinks may be attached to some or all of the plurality of heat generating electrical hardware components. The heat sinks may be attached to the heat generating electrical hardware components using, for example, a thermal interface material, a thermal adhesive, nut/bolt combinations, other devices, or a combination thereof. The heat sinks may aid in the transfer of heat from the plurality of heat generating electrical hardware components to the surrounding air.

One or more power supply units 116 (e.g., two power supply units) may be supported by the bottom 112 of the housing 100. The power supply units 116 may be releasably attached to the back 104 of the housing 100 using, for example, captive screws 118 attached to part of each power supply unit 116, and corresponding holes (e.g., tapped holes) in the back 104 of the housing 100. In other embodiments, the power supply units 116 may be attached to the housing 100 using, for example, nut/bolt combinations, flanges, tabs, other devices, or a combination thereof. The plurality of holes 114 in the back 104 of the housing 100 may be included in the power supply units 116 or may be separate from the power supply units 116. The switch may include different, additional, or fewer components.

Figure 2:
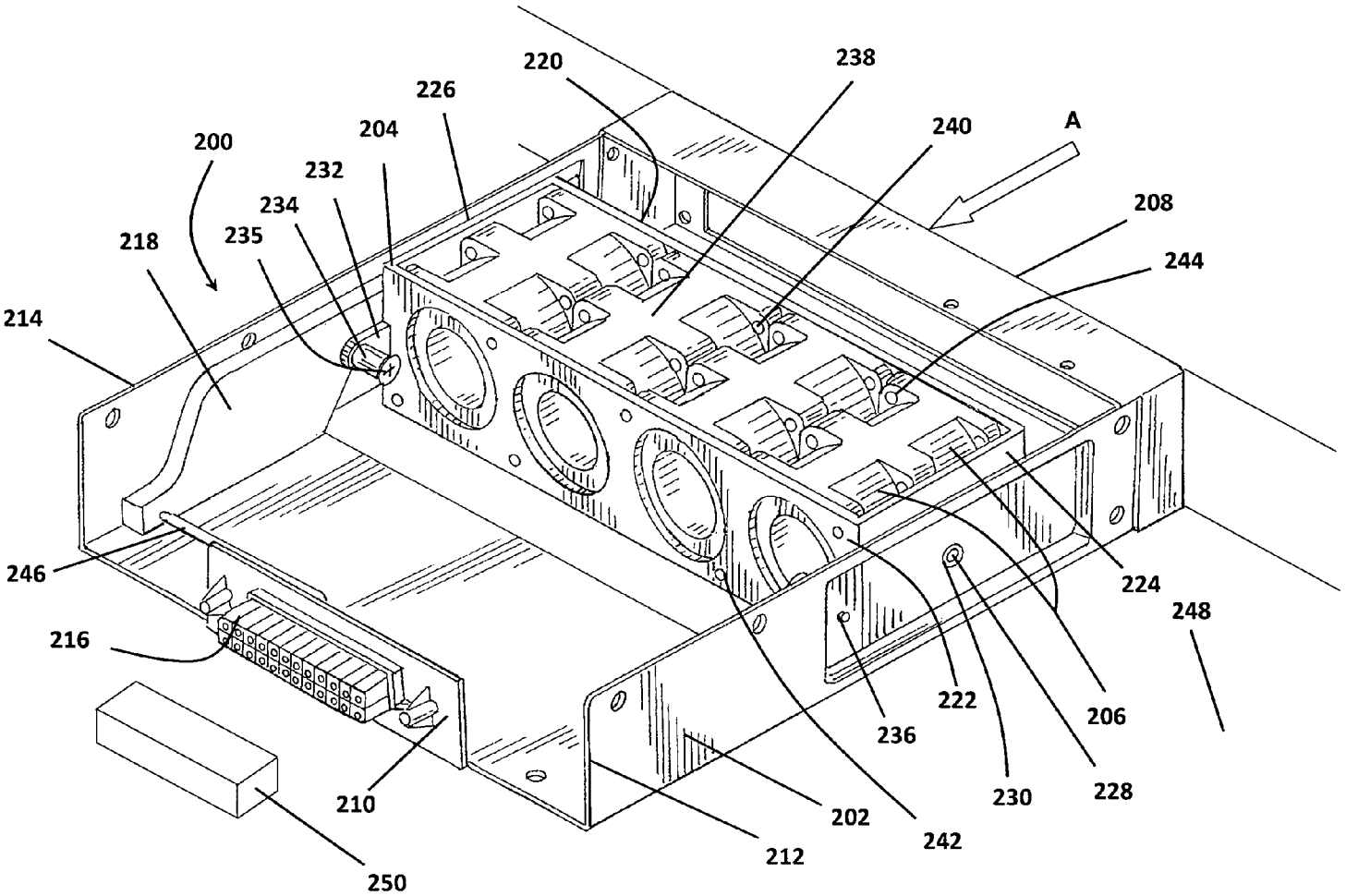
FIG. 2 illustrates a perspective view of one embodiment of a configurable fan unit.

FIG. 2 illustrates a perspective view of one embodiment of a configurable fan unit 200. The configurable fan unit 200 may be the configurable fan unit 115 shown in FIG. 1 or another configurable fan unit. The configurable fan unit 200 (e.g., a fan tray) may be removably inserted into the switch shown in FIG. 1 or a different stacked computer system. The configurable fan unit 200 may be inserted into a corresponding opening in the back 104, the front 102, the first side 106, the second side 108, the top 110 or the bottom 112 of the housing 100. The configurable fan unit 200 may be attached to the housing 100 above or below the bottom 112 of the housing 100.

The configurable fan unit 200 includes a housing 202, a fan housing 204, and a plurality of fans 206 (e.g., eight fans). The housing 202 includes a front 208, a back 210, a first side wall 212 and a second side wall 214. The housing 202 may be any number of shapes including, for example, rectangular. The housing 202 may be hollow or at least partially solid. The housing may be made of any number of materials including, for example, plastic.

The back 210 of the housing 202 includes an electrical connector 216 extending in a direction away from the back 210 of the housing 202. In other embodiments, the electrical connector 216 is on the front 208, the first side wall 212, the second side wall 214, or another surface of the housing 202. The electrical connector 216 may be a single 24-pin connector (e.g., three pins per fan 206 of the plurality). Alternatively, the electrical connector 216 may include four pins or six pins per fan 206 of the plurality. In one embodiment, a plurality of electrical connectors (e.g., 3-pin electrical connectors) extend from the back 210 of the housing 202, in a direction away from the back 210 of the housing 202. A male connector is shown extending from the back 210 of the housing 202. In other embodiments, the electrical connector 216 is a female electrical connector extending into the housing 202.

The second side wall 214 includes a cable or wire retainer 218 (e.g., wire retainer) that extends from an internal surface of the second side wall 214, in a direction away from the internal surface of the second side wall 214. The wire retainer 218 may extend from an internal surface of the first side wall 212 instead of or in addition to the internal surface of the second side wall 212. The wire retainer 218 may be made of any number of materials including, for example, die cast plastic.

The fan housing 204 includes a front 220, a back 222, a first side 224 and a second side 226. The fan housing 204 is rotatably attached to the first side wall 212 and the second side wall 214 of the housing 202 with corresponding pins 228 that extend from the first side 224 and the second side 226 of the fan housing 204, respectively. The first side wall 212 and the second side wall 214 may include holes 230 sized and shaped, such that the pins 228 on the fan housing 204 are operable to rotate within the holes 230. Thus, the fan housing 204 is operable to rotate relative to the housing 202. Alternatively, pins may extend from the first side wall 212 and the second side wall 214 of the housing 202, and the fan housing 204 may include holes sized and shaped, such that the fan housing 204 is operable to rotate around the pins. The fan housing 204 may be made of any number of materials including, for example, plastic.

The back 222 of the fan housing 204 may include one or more (e.g., two) flanges 232 and a locking mechanism 234 attached to each of the one or more flanges 232. The locking mechanisms 234 rotationally fix the fan housing 204 relative to the housing 202. The locking mechanisms 234 may be captive screws 235, for example, that are screwed into corresponding threaded holes 236 in the first side wall 212 and/or the second side wall 214 of the housing 202. In other embodiments, the fan housing 204 may be rotationally fixed relative to the housing 202 using, for example, spring-loaded pegs, nut/bolt combinations, flanges, tabs, latches, other devices, or a combination thereof. The locking mechanisms 234 may extend from other surfaces of the fan housing 204 (e.g., the first side 224 and the second side 226) and/or the housing 200 (e.g. the internal surface of the first side wall 212 and the internal surface of the second side wall 214). In one embodiment, the configurable fan unit 200 does not include the locking mechanism 234.

The fan housing 204 supports the plurality of fans 206 (e.g., eight fans). The plurality of fans 206 may include a plurality of fan modules 238. Each fan module 238 of the plurality may be attached to one or more internal surfaces of the fan housing 204 using pins 240 sized and shaped to fit into corresponding holes 242 in the fan housing 204 and corresponding holes 244 in the plurality of fan modules 238. In other embodiments, the plurality of fan modules 238 may be attached to the fan housing 204 using, for example, spring-loaded pegs, screws, flanges, tabs, other devices, or a combination thereof. The fan housing 204 may be any number of materials including, for example, plastic. The fan housing 204 may be a box-type housing and may be any number of shapes including, for example, a rectangular box. Other non-box housings may also be used. The fan housing 204 may not include a top or a bottom such that the plurality of fan modules 238 may be easily accessed, removed and/or replaced. In one embodiment, other than inlets and outlets of the plurality of fan modules 238, the plurality of fan modules 238 is surrounded by the fan housing 204, and the plurality of fan modules 238 is not attached to the fan housing 204.

Each fan module 238 of the plurality may include two or more fan rotors that are co-axial. Each fan module 238 of the plurality may be a single device or may be two or more fans 206 of the plurality attached to each other with pins, for example. The plurality of fan modules 238 may be positioned in the fan housing 204, such that the axes of rotation of the plurality of fan modules 238 are offset and parallel. In one embodiment, the axes of rotation of the plurality of fan modules 238 are in-line. In one embodiment, the fan housing 204 supports a single fan 206.

The plurality of fans 206 may include variable speed axial fans, for example. Other types of air movers including, for example, cross flow fans, centrifugal fans, backward curve impeller blowers or squirrel cage blowers may be used in addition to or instead of the variable speed axial fans 206. Each fan 206 of the plurality may include a DC brushless motor to rotate the fan 206. Low voltage such as, for example, 12 V may be used to power the motors of the plurality of fans 206. In one embodiment, each fan 206 of the plurality has a diameter of 120 mm. In other embodiments, different sized fans (e.g., 90 mm diameter fans) may be used.

The plurality of fan modules 238 may be electrically connected to the electrical connector 216 with a plurality of wires bundled in a single cable 246. The cable 246 may run from the fan housing 204, through the wire retainer 218 and to the electrical connector 216. In one embodiment, the cable 246 may not be used to bundle the plurality of wires, and the plurality of wires may run from the plurality of fan modules 238, through the wire retainer 218 and to the electrical connector 216.

The bottom 112 of the housing 100 may support a PCB 248. A switch-side connector 250 may be supported by and electrically connected (e.g., soldered) to the PCB 248 or another substrate. The electrical connector 216 may be physically mated with and electrically connected to the switch-side connector 250. The electrical connector 216 and the switch-side connector 250 may be mated plugs, for example. The switch-side connector 250 may be a female electrical connector, for example. In one embodiment, the switch-side connector 250 is a male electrical connector.

The PCB 248 may include one or more fan controllers electrically connected to a memory and the switch-side connector 250 via traces on the PCB 248. The fan controller may include one or more application specific integrated circuits, general processors, digital signal processors, combinations thereof, or other now known or later developed processor. The memory may include one or more of a read only memory (ROM), dynamic random access memory (DRAM), an optical or magnetic storage device, or any other type of memory or data storage device.

The fan controller may generate and transmit control signals (e.g., pulse width modulation signals and rotational direction control signals) to the plurality of fan modules 238 (e.g., via the PCB 248, the switch-side connector 250, the electrical connector 216, and the cable 246) based on data stored in the memory (e.g., fan speed tables) and/or sensor signals received from the plurality of fan modules 238, for example. The switch-side connector 250 may be electrically connected to outputs of the one or more power supply units 116 via traces on the PCB 248 to provide power to the plurality of fan modules 238. The pulse width modulation or other signals may control the voltage applied to the plurality of fan modules 238 (e.g., the motors of the plurality of fan modules 238), thus controlling the rotational speed of each fan 206 of the plurality.

The plurality of wires bundled in the cable 246 may include wires that transmit power (e.g., 12 V) to each fan 206 of the plurality, wires that transmit control signals (e.g., pulse width modulation and rotational direction control) to each fan 206 of the plurality, wires that transmit sensor signals (e.g., RPM of the plurality of fan modules 238 and/or a locked motor alarm signal when the fan rotor is stopped) from each fan 206 of the plurality, and wires that are grounded. The sensor signals may be transmitted to the fan controller via the switch-side connector 250. The sensor signals may be used by the fan controller to generate the control signals.

In FIG. 2, the fan housing 204 is in a first orientation relative to the housing 202 to move air through the configurable fan unit 200 in a first direction (e.g., back-to-front; arrow A) relative to the switch. The locking mechanisms 234 rotationally fix the fan housing 204 in the first orientation relative to the housing 202. The locking mechanisms 234 may be unlocked, and the fan housing 204 may be rotated 180° (e.g., clockwise at the second side 226 of the fan housing 204), for example, into a second orientation relative to the housing 202 to move air through the configurable fan unit 200 in a second direction (e.g., front-to-back; arrow B shown in FIG. 4) relative to the switch. One or more stops may extend from the housing 202 and/or the fan housing 204 to limit the rotation of the fan housing 204 relative to the housing 202. In one embodiment, the one or more stops may be holes or dents in the first side wall 212 and/or the second side wall 214 of the housing 202. The locking mechanisms 234 may rotationally fix the fan housing 204 in the second orientation relative to the housing 202. In other embodiments, the fan housing 204 may be rotated more or less than 180°.

Figure 3:
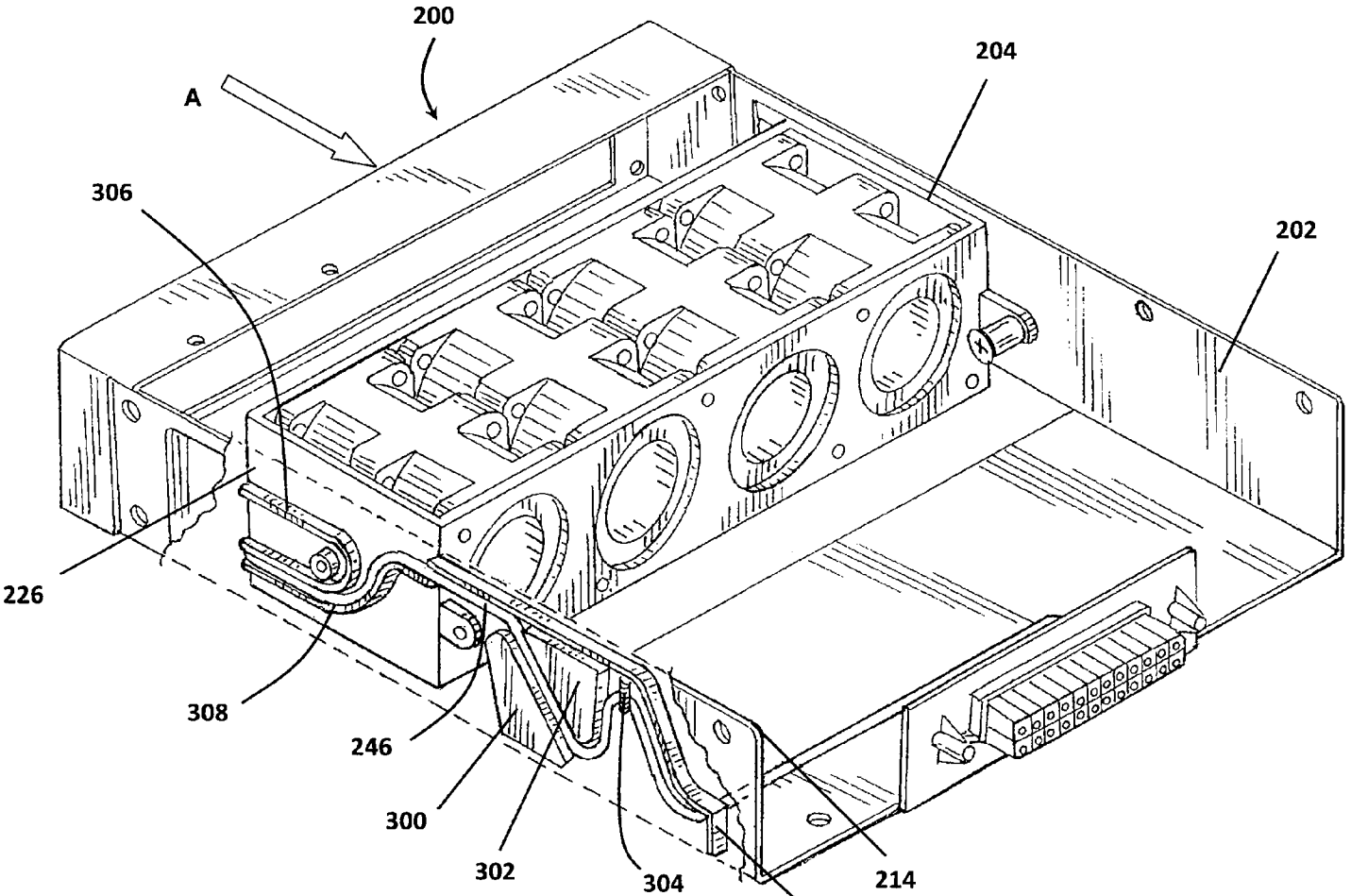
FIG. 3 illustrates a perspective view of one embodiment of a configurable fan unit with a fan housing in a first orientation.

During the rotation of the fan housing 204 relative to the housing 202, the wire retainer 218 helps guide the cable 246. FIG. 3 illustrates a perspective view of one embodiment of the configurable fan unit 200 of FIG. 2 or a different configurable fan unit in the first orientation with part of the second side wall 214 of the housing 202 removed. The wire retainer 218 includes a first guide 300, a second guide 302 and a spring 304. The first guide 300 and the second guide 302 are sized and shaped such that the cable 246 moves between the first guide 300 and the second guide 302 when the fan housing 204 moves between the first orientation and the second orientation. A distance between the first guide 300 and the second guide 302 may be greater than or approximately equal to the diameter of the cable 246. The first guide 300 and the second guide 302 may be integral parts of the wire retainer 218 and may be die-cast plastic, for example. Alternatively, the first guide 300 and the second guide 302 may be separate parts from the wire retainer 218 and may be attached to the wire retainer 218 with an adhesive, for example. In one embodiment, the wire retainer 218 does not include the first guide 300 and/or the second guide 302.

A first end of the spring 304 is attached to an internal surface of the wire retainer 218 using, for example, an adhesive or a flange including a hole, through which the first end of the spring 304 is disposed. A second end of the spring 304 may at least partly encircle the cable 246. The second end of the spring 304 may be a hook, for example, that at least partly supports the cable 246. The spring 304 may be a coil spring or a leaf spring, for example. In one embodiment, the spring 304 is a tension coil spring. Other devices such as, for example, a zip tie may be used instead of or in addition to the spring 304. In the first orientation, as shown in FIG. 3, the spring 304 may be in an unloaded position, and slack in the cable 246 may be lifted towards a top internal surface of the wire retainer 218.

The second side 226 of the fan housing 204 may include an inner retainer 306 and an outer retainer 308. The inner retainer 306 and the outer retainer 308 may be raised walls, may be formed by grooves in the second side 226 of the fan housing 204 or may be a combination thereof. The inner retainer 306 and/or the outer retainer 308 may be integral parts of the second side 226 of the fan housing 204. Alternatively, the inner retainer 306 and/or the outer retainer 308 may be separate parts from the fan housing 204 and may be attached to the second side 226 of the fan housing 204 using an adhesive, for example. In one embodiment, the second side 226 of the fan housing 204 may not include the outer retainer 308. Other sides of the housing 202 and/or the fan housing 204 (e.g., the second side 226) may include inner and/or outer retainers.

The inner retainer 306 may be any number of shapes including, for example, u-shaped. Along at least part of the outer perimeter of the inner retainer 306, a distance between the inner retainer 306 and the outer retainer 308 is greater than or approximately equal to the diameter of the cable 246. In the first orientation, the cable 246 may wrap around less than the entire inner retainer 306, and the outer retainer 308 may guide the cable 246 into the wire retainer 218. As the fan housing 204 is rotated relative to the housing 202 into the second orientation, the cable 246 further wraps around the inner retainer 306 until the cable 246 wraps around the entire inner retainer 306, and the inner retainer 306 guides the cable 246 into the wire retainer 218.

Figure 4:
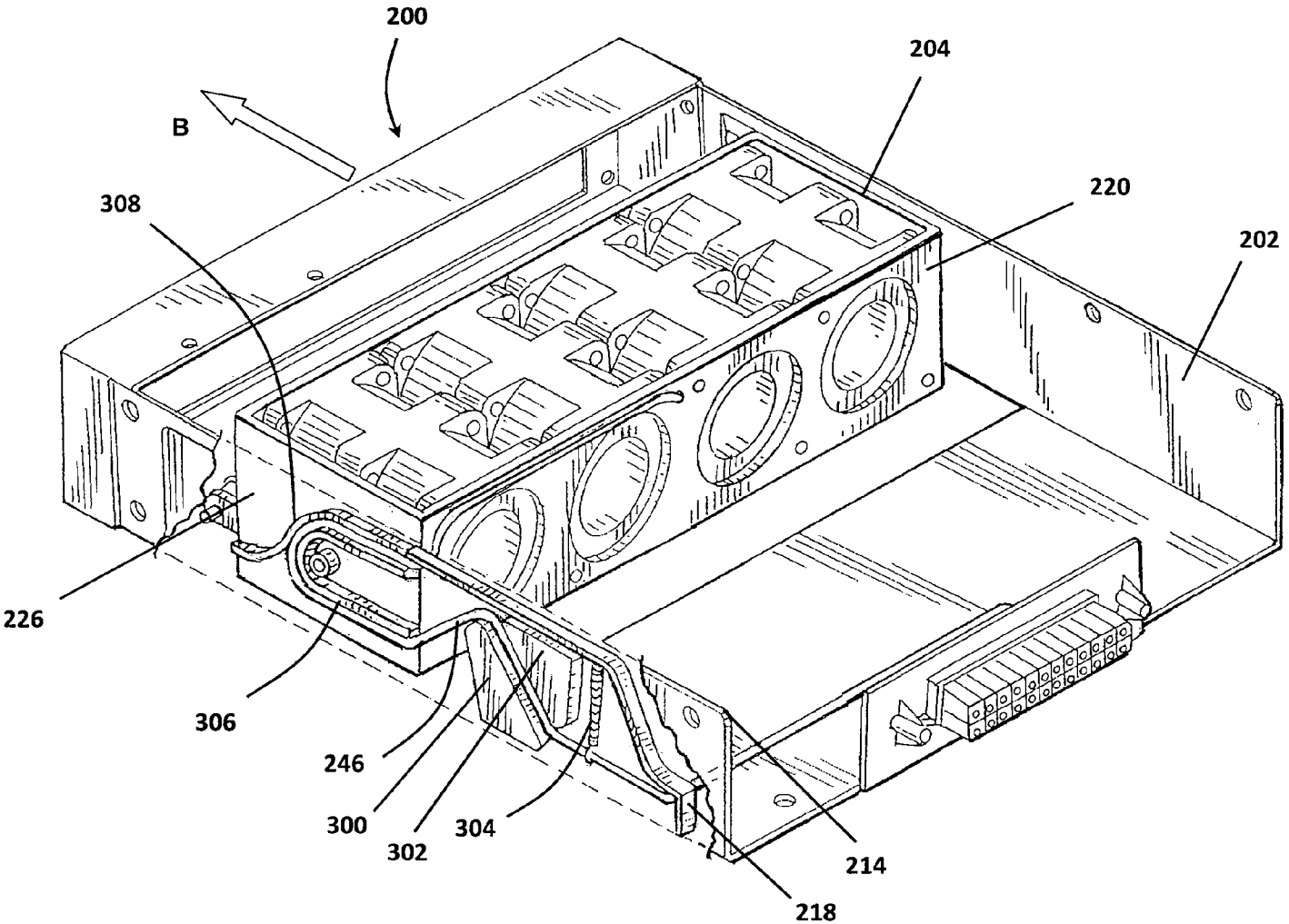
FIG. 4 illustrates a perspective view of one embodiment of the configurable fan unit of FIG. 3 with the fan housing in a second orientation.

FIG. 4 illustrates a perspective view of one embodiment of the configurable fan unit 200 of FIG. 3 in the second orientation with part of the second side wall 214 of the housing 202 removed. As the fan housing 204 is rotated into the second orientation, the slack in the cable 246 is removed, and a load is applied to the spring 304, thus extending the spring 304. In the second orientation, the cable 246 runs across a part of the front 220 of the fan housing 204, between the inner retainer 306 and the outer retainer 308 on the second side 226 of the fan housing 204, around the inner retainer 306, and between the first guide 300 and the second guide 302 of the wire retainer 218. The wire retainer 218 and the inner retainer 306 and the outer retainer 308 on the fan housing 204 keep the cable 246 in place during and after rotation of the fan housing 204 relative to the housing 202. By keeping the cable 246 in place during and after rotation of the fan housing 204 relative to the housing 202, damage to the cable 246 may be prevented when the orientation of the fan housing 204 is changed and/or during storage of spare configurable fan units 200.

By using the configurable fan unit 200, one type of switch, for example, may be installed in a data center, regardless of the position (e.g., hot aisle or cold aisle) of the switch in the data center. If the airflow direction needs to be changed (e.g., back-to-front airflow to front-to-back airflow), the configurable fan unit 200 may be removed from the switch, the fan housing 204 may be rotated relative to the housing 202, and the configurable fan unit 200 may be removably re-inserted into the switch in a second orientation. With the fixed airflow direction switches of the prior art, spares may be maintained for both versions of the switch (e.g., back-to-front and front-to-back versions) in case of a failure within the data center. Also, each version may only be installed within certain locations in the data center (e.g., hot aisle or cold aisle). The configurable fan unit 200 of the present embodiments increases the flexibility of the positioning of the switch within the data center, as the fan housing 204 may be reoriented relative to the housing 202 of the configurable fan unit 200 after installation to change the airflow direction. Also, spares of only a single switch version may be maintained, thus reducing the number of spare switches that may be purchased for the data center. The configurable fan unit 200 may include a single electrical connector 216 that is oriented in the same direction relative to the switch regardless of the orientation of the fan housing 204 relative to the housing 202.

The configurable fan unit 200 of the present embodiments may be used in any number of other systems including, for example, computers, servers, and stereo equipment (e.g., receivers and amplifiers). The configurable fan unit 200 may be used in any system that includes heat-generating components that are convectively cooled. The configurable fan unit 200 may also be used in any system that is included in a vertically stacked arrangement (e.g., racks in a data center).

Figure 5:
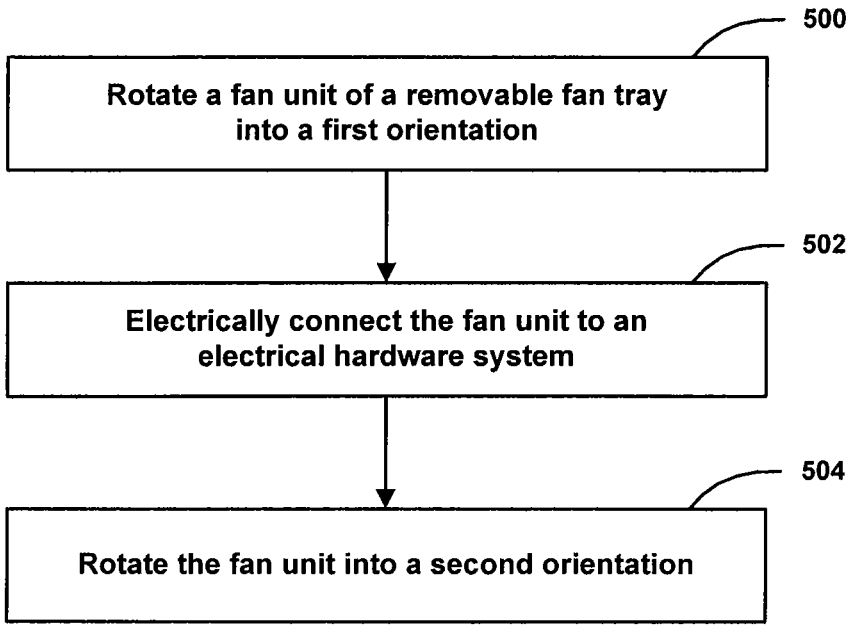
FIG. 5 illustrates a flow chart of using a configurable fan unit, according to one embodiment.

FIG. 5 illustrates a flow chart of one embodiment of using the configurable fan unit 200 shown in FIGS. 2-4 or a different configurable fan unit. The method is implemented in the order shown, but other orders may be used. Additional, different, or fewer acts may be provided.

At block 500, a fan unit of a removable fan tray is rotated into a first orientation relative to a housing of the removable fan tray. The fan unit may be rotatably attached to the housing of the removable fan tray using, for example, pins extending from one or more sides of the fan unit and corresponding holes in the housing of the removable fan tray. Alternatively, the pins may extend from one or more sides of the housing, and the corresponding holes may be located in the fan unit. The fan unit and/or the housing may include stops extending from one or more sides of the fan unit and/or the housing to prevent over-rotation of the fan unit relative to the housing.

The fan unit may include one or more locking mechanisms that extend from one or more sides of the fan unit. In one embodiment, a locking mechanism includes a flange that extends from a back of the fan unit and a captive screw attached to the flange. The captive screw is inserted into a corresponding hole (e.g., tapped or untapped) in the housing to rotationally fix the fan unit in the first orientation relative to the housing of the removable fan tray. In other embodiments, the fan unit may be rotationally fixed relative to the housing, for example, spring-loaded pegs, nut/bolt combinations, flanges, tabs, latches, other devices, or a combination thereof.

At block 502, the fan unit of the removable fan tray is electrically connected to an electrical hardware system. The fan unit may include a fan housing and one or more fans (e.g., four fan modules, eight fans) supported in the fan housing. The removable fan tray may include an electrical connector extending from a back of the housing. The one or more fans supported in the fan unit may be electrically connected to the electrical connector with a plurality of wires bundled in a cable. The cable may run from the fan unit, through a wire retainer on the housing of the removable fan tray and to the electrical connector. The electrical connector may be a 24-pin connector (e.g., 3 pins per fan), for example. In other embodiments, separate 3-pin, 4-pin or 6-pin connectors may be used for each of the one or more fans.

The removable fan tray may be inserted into a corresponding hole in a side, a top or a bottom of the electrical hardware system. The electrical hardware system may be a switch, for example. The removable fan tray may be slid along an internal surface of the electrical hardware system such that the electrical connector is mated with and electrically connected to an electrical hardware system-side connector. Regardless of the orientation of the fan unit relative to the housing of the removable fan tray (e.g., the first orientation), the removable fan tray may be positioned in the same orientation relative to the electrical hardware system, and thus, the electrical connector may be positioned in the same orientation relative to the electrical hardware system-side connector. In other words, the removable fan tray is installed in the electrical hardware system the same regardless of the rotational position of the fan unit relative to the housing of the removable fan tray.

The housing of the removable fan tray may include one or more holes in a top, a bottom and/or a side of the housing. The removable fan tray may be removably attached to the electrical hardware system at the one or more holes in the housing, for example, screws and corresponding tapped holes in the electrical hardware system. In one embodiment, a front of the housing of the removable fan tray may include a flange that extends past a side of the housing. The removable fan tray may be removably attached to the electrical hardware system at the flange using a captive screw attached to the flange, and a corresponding hole (e.g., tapped hole) in the electrical hardware system. Other fastening devices including, for example, nut/bolt combinations or other devices may be used instead of or in addition to the screws.

The electrical hardware system-side connector may be electrically connected to one or more outputs of power supplies via traces on a printed circuit board (PCB) of the electrical hardware system, for example. The power supplies of the electrical hardware system may provide power (e.g., 12V) to the one or more fans of the fan unit. The electrical hardware system-side connector may also be electrically connected to one or more outputs of a fan controller via traces on the PCB of the electrical hardware system. The fan controller may generate and transmit control signals (e.g., rotational speed control signals (pulse width modulation) and rotational direction control signals) to the electrical hardware system-side connector. The fan controller may include one or more application specific integrated circuits, general processors, digital signal processors, combinations thereof, or other now known or later developed processor.

The electrical connection between the electrical connector on the housing and the electrical hardware system-side connector may be configured to move rotors of the one or more fans in a rotational direction such that air moves through the fan unit in a corresponding direction. In the first orientation of the fan unit relative to the housing of the removable fan tray, the one or more fans of the fan unit may move air through the electrical hardware system in a first direction (e.g., back-to-front).

At block 504, the fan unit is rotated into a second orientation relative to the housing of the removable fan tray. The removable fan tray may be detached from the electrical hardware system using the screws, for example, and may be removed from the electrical hardware system. The captive screw of the locking mechanism may be unscrewed to unlock the orientation of the fan unit relative to the housing of the removable fan tray. The fan unit may be rotated 180° into the second orientation, for example. The stops may again prevent over-rotation of the fan unit relative to the housing of the removable fan tray. The stops may only allow complete rotation in one direction. The captive screw of the locking mechanism may be inserted into another corresponding hole (e.g., tapped or untapped) in the housing to rotationally fix the fan unit in the second orientation relative to the housing of the removable fan tray. In one embodiment, the fan unit may be rotated relative to the housing of the removable fan tray without being removed from the electrical hardware system. In other words, a top and a bottom of the electrical hardware system may include openings, such that the fan unit may be rotated relative to the housing of the removable fan tray without removing the removable fan tray from the electrical hardware system.

During the rotation of the fan unit relative to the housing of the removable fan tray, the wire retainer helps guide the cable. The wire retainer includes a first guide and a second guide that are sized and shaped such that part of the cable may be positioned between and move relative to the first guide and the second guide when the fan unit moves between the first orientation and the second orientation. The wire retainer also includes a spring having a first end attached to a top internal surface of the wire retainer, and a second end that at least partly encircles and supports (e.g., with a hook) part of the cable. The spring may be a tension coil spring, for example.

A side of the fan unit includes an inner retainer and an outer retainer. The inner retainer and the outer retainer may be raised walls or grooves in the side of the fan unit, for example. The inner retainer may be u-shaped, for example. In the first orientation of the fan unit, the cable wraps around part of an outer perimeter of the inner retainer and passes between the first guide and the second guide of the wire retainer to the electrical connector. The spring may be in an unloaded position when the fan unit is in the first orientation relative to the housing of the removable fan tray. In the unloaded position of the spring, slack in the cable may be lifted towards the top internal surface of the wire retainer. When the fan unit is rotated relative to the housing of the removable fan tray, the cable further wraps around the outer perimeter of the inner retainer on the side of the fan unit, the cable moves through a channel defined by the first guide and the second guide of the wire retainer in a direction towards a front of the housing, and the slack in the cable is removed. As the slack in the cable is removed, a load is applied to the spring, thus extending the spring. The wire retainer and the inner retainer and the outer retainer on the fan unit keep the cable in place during and after rotation of the fan unit relative to the housing of the removable fan tray.

The removable fan tray may be inserted into the electrical hardware system. The removable fan tray may be slid along the internal surface of the electrical hardware system such that the electrical connector is mated with and electrically connected to the electrical hardware system-side connector. The removable fan tray may be removably attached to the electrical hardware system at the one or more holes in the housing and/or the flange using the screws and/or the captive screw attached to the flange. In the second orientation of the fan unit relative to the housing of the removable fan tray, the one or more fans of the fan unit may move air through the electrical hardware system in a second direction (e.g., front-to-back).

Various embodiments described herein can be used alone or in combination with one another. The foregoing detailed description has described only a few of the many possible implementations of the present invention. For this reason, this detailed description is intended by way of illustration, and not by way of limitation.

The invention claimed is:

1. An apparatus comprising:

a housing comprising a first side wall and a second side wall;

a fan unit housing rotatably attached to the housing by a first joint at a first side wall of the fan unit housing and by a second joint at a second side wall of the fan unit housing, the first side wall of the fan unit housing being configured to face the first side wall of the housing and the second side wall of the fan unit housing positioned opposite the first side wall of the fan unit housing;

a fan supported by the fan unit housing; and an electrical connector attached to the housing, the electrical connector being electrically connected by a wire to the fan, wherein the fan unit housing is operable to be rotated into two different positions relative to the housing such that the fan moves air through the housing in two corresponding directions relative to the housing, and a wire support disposed on the first side wall of the housing, the wire support configured to face the first side wall of the fan unit housing and to engage and maintain at least a portion of the wire between the first side wall of the fan unit housing and the first side wall of the housing during rotation of the fan unit housing between the two different positions.

2. The apparatus of claim 1, wherein the housing further comprises a stop operable to limit the rotation of the fan unit housing relative to the housing.

3. The apparatus of claim 2, wherein the fan unit housing is operable to be rotated 180° relative to the housing.

4. The apparatus of claim 1, further comprising a locking mechanism attached to the fan unit housing, the locking mechanism being configured to rotationally fix the fan unit housing relative to the housing in each of the two different positions.

5. The apparatus of claim 4, wherein the locking mechanism is a captive screw, and wherein the fan unit housing is rotationally fixed to the housing with the captive screw and corresponding holes in the housing.

6. The apparatus of claim 1, wherein the fan unit housing comprises a corresponding wire support on the first side wall of the fan unit housing, the corresponding wire support on the fan unit housing being configured to engage and guide the wire between the wire support on the first side wall of the housing and the corresponding wire support on the first side wall of the fan unit housing during rotation of the fan unit housing between the two different positions.

7. An apparatus comprising:

a rack-mounted electrical hardware component comprising a heat generating component; and a fan unit removably insertable into the rack-mounted electrical hardware component, the fan unit comprising:

a housing comprising a first side wall and a second side wall;

a fan housing rotatably attached to the housing, the fan housing comprising a first side wall and a second side wall, the second side wall of the fan housing opposite the first side wall of the fan housing;

a plurality of fans supported by the fan housing;

an electrical connector attached to the housing, the electrical connector being electrically connected to the plurality of fans with a wire; and a wire support on the first side wall of the housing, the wire support being configured to face the first side wall of the fan housing and to guide and maintain at least a portion of the wire between the first side wall of the housing and the first side wall of the fan housing during rotation of the fan housing relative to the housing, wherein the electrical connector on the housing is operable to be physically mated with, and electrically connected to, a corresponding rack-mounted electrical hardware component-side connector, and wherein the fan housing is operable to be rotated into two different positions relative to the housing such that the plurality of fans move air through the rack-mounted electrical hardware component in two corresponding directions to cool the heat generating component.

8. The apparatus of claim 7, wherein the rack-mounted electrical hardware component is a switch.

9. The apparatus of claim 7, wherein the plurality of fans is supported by the fan housing such that axes of rotation of the plurality of fans are parallel.

10. The apparatus of claim 7, wherein each fan of the plurality is an axial fan.

11. The apparatus of claim 7, wherein the fan housing is operable to be rotated about 180° relative to the housing, and the housing further comprises a stop operable to limit the rotation of the fan housing relative to the housing.

12. The apparatus of claim 7, wherein the fan unit further comprises a locking mechanism attached to the fan housing, the locking mechanism being configured to rotationally fix the fan housing relative to the housing in each of the two different positions.

13. A method comprising:

rotating a fan unit of a removable fan tray into a first orientation relative to a housing of the removable fan tray, the fan unit being rotatably attached by a first revolute joint to a first side wall of the housing of the removable fan tray and by a second revolute joint to a second side wall of the housing of the removable fan tray such that the fan unit is rotatable to the first orientation and a second orientation different than the first orientation, the first orientation configured to move air in a first direction and the second orientation configured to move air in a second direction; and electrically connecting the fan unit of the removable fan tray to an electrical hardware system, the connection configured to power the fan unit;

wherein rotating the fan unit into the first orientation relative to the housing of the removable fan tray comprises guiding a wire that electrically connects an electrical connector on the removable fan tray with the fan unit using a wire support on the first side wall of the housing of the removable fan tray to guide the wire between the first side wall of the housing of the removable fan tray and a side wall of the fan unit, the side wall of the fan unit facing the first side wall of the housing; and wherein electrically connecting the fan unit comprises physically mating the electrical connector on the removable fan tray with an electrical hardware system-side connector.

14. The method of 13, further comprising inserting the removable fan tray into the electrical hardware system, wherein the electrical connector on the removable fan tray is electrically connected to the electrical hardware system-side connector when the removable fan tray is inserted into the electrical hardware system.

15. The method of 14, further comprising:

removing the removable fan tray from the electrical hardware system; and rotating the fan unit into the second orientation relative to the removable fan tray by rotating the fan about 180° relative to the housing.

16. The apparatus of claim 1, wherein the wire support comprises a groove formed in the first side wall of the housing.

17. The apparatus of claim 1, wherein the wire support comprises a protrusion from the first side wall of the housing.

18. The apparatus of claim 1, wherein the wire support on the first side wall of the housing comprises:

a first retainer configured to engage a first portion of the wire nearer the electrical connector to maintain the first portion of the wire along the first side wall of the housing; and a second retainer configured to engage a second portion of the wire nearer the fan to maintain the second portion of the wire between the first side wall of the housing and the first side wall of the fan unit housing.

19. The apparatus of claim 18, wherein the wire support further comprises a spring attached to the housing and configured to engage the wire to reduce slack in the wire during rotation of the fan unit housing between the two different positions.

* * * * *